United States Patent [19]

Espy

[11] 3,939,816

[45] Feb. 24, 1976

[54] GAS FILLED COAXIAL ACCELERATOR WITH COMPRESSION COIL

[75] Inventor: Patrick N. Espy, Huntsville, Ala.

[73] Assignee: The United States of America as represented by the National Aeronautics and Space Administration Office of General Counsel-Code GP, Washington, D.C.

[22] Filed: July 12, 1974

[21] Appl. No.: 488,614

[52] U.S. Cl. ..... 124/11 R; 73/12; 89/8; 315/111.4; 315/111.5; 315/111.6

[51] Int. Cl.[2] ..... F41F 1/02; F41F 1/04

[58] Field of Search ..... 124/3, 11; 328/233; 313/231.4, 362; 315/111, 111.1, 111.2, 111.4, 111.5, 111.6, 111.7; 73/12; 89/8

[56] References Cited

UNITED STATES PATENTS 3,854,097 12/1974 Fletcher et al. ..... 328/233

*Primary Examiner*—Stephen C. Bentley
*Assistant Examiner*—Salvatore Cungialosi
*Attorney, Agent, or Firm*—Wayland H. Riggins; L. D. Wofford, Jr.; John R. Manning

[57] ABSTRACT

A self-energized plasma compressor which compresses plasma discharged from a coaxial plasma generator. The device includes a helical shaped coil which is coaxially aligned with the center axis of the coaxial plasma generator. The plasma generator creates a current through the helical coil which, in turn, generates a time varying magnetic field that generates a force which acts radially upon the plasma. A seal is carried on the end of the coaxial plasma generator for containing gas therein. As the plasma is accelerated out the outer end of the generator, it forces the gas outwardly also compressing such. Beads are carried adjacent the small end of the helical shaped coil for being accelerated to hypervelocities by the plasma and gas. As a result of utilizing gas in the coaxial plasma generator, such minimizes ablation of the beads as well as accelerates such to higher velocities.

5 Claims, 2 Drawing Figures

GAS FILLED COAXIAL ACCELERATOR WITH COMPRESSION COIL

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates generally to a plasma generator and more particularly to a plasma generator constructed to propel small projectiles to hypervelocities. Heretofore, in order to propel small objects such as beads, at hypervelocities for simulating meteoroids that may be encountered while traveling in outer space, it has been necessary to propel such from chemical explosions, from electrical exploded wires, or from electrostatic accelerometers. While these apparatus may be able to propel very small particles at hypervelocities, they are not satisfactory for larger particles.

In order to obtain high velocity bursts, devices have been developed, such as shown in U.S. Pat. No. 3,579,028 and U.S. Pat. No. 2,992,345. In a co-pending application, bearing Ser. No. 367,606, entitled "Self-Energized Plasma Compressor," also assigned to the National Aeronautics and Space Administration, there is disclosed a self-energized plasma compressor which has a helical coil coaxially aligned with the center axis of a coaxial plasma generator so as to compress the plasma for engaging beads to accelerate such to hypervelocities.

However, such devices do not disclose utilizing gas as well as a helical coil for moving plasma to a narrow end of a coil for engaging objects to propel them at hypervelocities. The disadvantages of prior devices was generally the limitation in mass and velocity achievable for particles. These limitations resulted from the combined characteristic limitation in velocity density and controllability of temperatures of the accelerating medium.

SUMMARY OF THE INVENTION

The plasma generator constructed in accordance with the present invention is a self-energized plasma compressor wherein gas is inserted within the plasma generator for being compressed by ionized particles. The device includes an elongated cylindrical first electrode with a central rod electrode disposed coaxially thereof and out of contact therewith. An electrically conductive element extends between the central rod electrode and an inner end of the first electrode. The inner end of the first electrode is sealed with a plug and a rupturable seal is carried on the other end thereof. Means is provided for inserting gas within the elongated cylindrical first electrode.

An elongated electrically conductive helical coil having a large diameter end and a small diameter end is carried adjacent the outer end of the first electrode with the small diameter end being spaced longitudinally therefrom. Means is provided for electrically connecting the small diameter end of the helical coil to the first electrode. Means is provided for applying a high voltage to the first electrode and the central rod electrode for causing the electrically conductive element to ionize producing a plasma which is accelerated forcing the gas out of the outer end of the first electrode rupturing the seal. The helical coil is carried in axial alignment with the elongated cylindrical first electrode so that a current path is formed between an outer end of the central electrode and the helical coil as the plasma and gas are accelerated out the outer end of the first electrode producing current flow through the helical coil which, in turn, produces a time varying magnetic field that compresses the plasma and gas adjacent the small diameter end of the coil.

Beads are carried on a mylar seal carried adjacent the small diameter end of the helical coil for being engaged by the plasma and gas. The gas in the accelerator system adds to the driving mass and is accumulated in a "snow plow" effect in front of the discharging material, such as aluminum, so as to produce a lower eroding effect on the particles which are to be accelerated as a result of the lower temperature thereof. Such also increases the achievable velocities of the particles or beads carried on the mylar seal.

Accordingly, it is an important object of the present invention to provide a plasma generator which can propel objects such as glass beads to hypervelocities.

Another important object of the present invention is to provide a gas filled coaxial accelerator equipped with a compressor coil so as to increase the driving mass of the accelerator.

Still another important object of the present invention is to provide a plasma type hypervelocity accelerator wherein gas is discharged with ionized plasma minimizing the eroding effect on particles that are to be accelerated.

Still another important object of the present invention is to provide a plasma type hypervelocity accelerator wherein gas is utilized therein for increasing the density of the accelerating medium.

These and other objects and advantages of the invention will become apparent upon reference to the following specification, attendant claims and drawings.

DESCRIPTION OF THE PREFERRED EMBODIMENT

Figure 1:
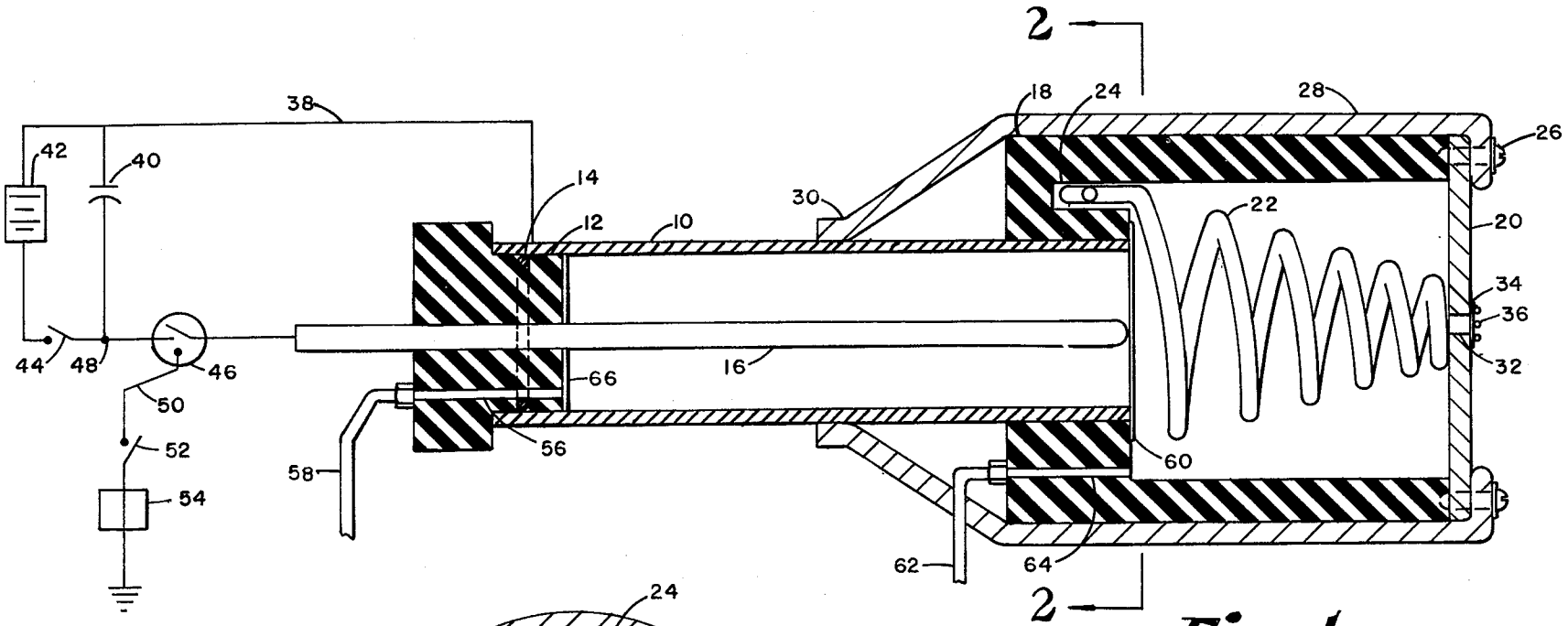
FIG. 1 is a longitudinal, sectional view, partially in schematic form, illustrating a self-energized plasma compressor constructed in accordance with the present invention.
Figure 2:
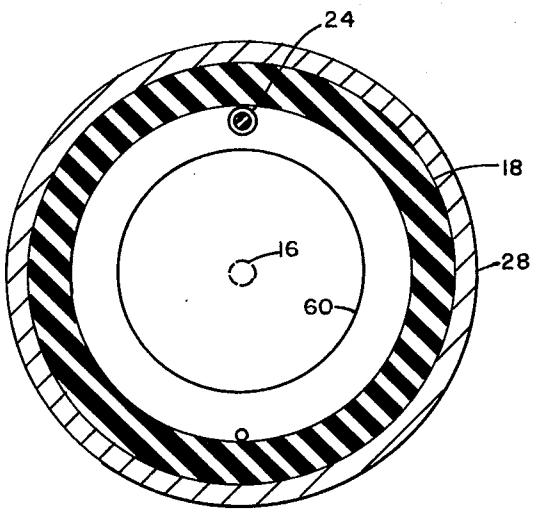
FIG. 2 is a cross-sectional view taken along line 2—2 of FIG. 1.

Referring in more detail to the drawing, there is illustrated a plasma generator which has a cylindrical elongated annular electrode 10 constructed of any suitable material such as steel. An insulating plug 12 is carried on the inner end of the electrode 10 and has an O ring 14 provided in an annular groove therein for producing a positive seal between the cylindrical electrode 10 and the plug 12. An elongated rod electrode 16 extends through the plug 12 along the longitudinal axis of the cylindrical electrode 10. The outer end of the rod electrode 16 terminates slightly within the cylindrical electrode 10. A sealed insulator housing 18 is carried on the outer end of the cylindrical electrode 10 and is secured thereto by any suitable means such as adhesive. The outer end of the insulator housing 18 is constructed of a conductive plate 20 which will be described more fully below.

An electrically conductive helical compressor coil 22 has one end secured within a groove 24 provided in the insulating housing 18 closely adjacent the outer end of the electrode 10. The helical compressor coil 22 extends outwardly from adjacent the outer end of the electrode 10 in a helical spiral. As can be seen, the large diameter end of the helical coil 22 is spaced from the outer end of the electrode 10. The outer or small diameter end of the helical coil 22 is attached to the conductive plate 20 such as by welding. An electrical path is provided through the conductive plate 20, screws 26, and cylindrical housing 28 back to the outer electrode 10 by the downwardly extending cylindrical arm 30 which is welded to the electrode 10. It is noted that the plate 20 has an opening 32 provided therein which is in axial alignment with the helical coil 22. Positioned over the opening 32 is a mylar disc 34 which has a plurality of glass beads 36 or the like positioned thereon for being accelerated by the accelerator.

In order to energize the plasma generator, an electrical conductor 38 is connected between the cylindrical electrode 10 and one side of a capacitor bank 40 shown schematically as a single capacitor. Also, connected to the same side of the capacitor bank 40 is the output of a DC power supply 42. The other side of the DC power supply 42 is connected through a switch 44 to one electrode of an ignitron switch 46. Interposed between the ignitron switch 46 and the switch 44 is a junction 48 to which the other side of the capacitor bank 40 is coupled. A control electrode 50 of the ignitron switch 46 is connected through a switching mechanism shown schematically at 52 to one side of a DC power supply 54. The other side of the DC power supply 54 is grounded.

The insulator plug 12 has a passage 56 extending therethrough to which a gas line 58 is connected. Such is to permit gas to be inserted within the cylindrical electrode 10. In order to contain the gas a mylar sheet 60 is secured over the outer end of the cylindrical electrode 10 by gluing such to the insulating housing 18. In some situations it is also desirable to insert a gas within the insulated housing 18. Such is accomplished by connecting a gas line 62 to a port 64 extending through the insulated housing 18.

In operation, upon closing the switch 44 of the DC power supply 42, such causes the capacitor bank 40 to charge to a predetermined level. When switch 44 is closed such, in turn, causes the ignitron switch 46 to close. Upon closing of the ignitron switch 46, the capacitor 40 discharges through the central electrode 16, a circular aluminum foil 66, cylindrical electrode 10 and back through lead 38 completing the circuit. As current flows through the aluminum foil 66 such causes the foil to be heated and ionized. When the foil 66 is ionized, it forms a plasma which is accelerated out of the cylindrical electrode 10 by the magnetic field surrounding the elongated electrode 16. As the plasma is accelerated out of the cylindrical electrode 10 the residual gas included therein is accumulated in a snow plow effect in front of the discharging plasma.

Compressed gas and plasma rupture the seal 60. As the gas and plasma exit from the end of the cylindrical electrode 10, it forms an electrical path from the end of the elongated electrode 16 to the helical coil 22. Current begins to flow through the helical coil 22 creating a longitudinal magnetic field within the coil 22 which varies in time with the potential applied to the electrodes 10 and 16 of the coaxial plasma generator.

This time varying magnetic field creates a circular current within the plasma inside the coil 22. This circular current interacts with the axial magnetic field and creates a radial force by which the plasma is contained within the coil. Since the plasma leaves the cylindrical electrode 10 of the coaxial generator with a velocity component directly along the longitudinal axis, it is compressed into the narrow end of the compressor coil 22 along with the gas contained therein.

When the potential applied to the rod electrode 16 and the cylindrical electrode 10 of the coaxial generator begins to decrease, the magnetic field created by the helical coil 22 also begins to decrease, and the current induced in the plasma by the magnetic field changes direction. Since the magnetic field has not changed direction but the current in the plasma has, the force on the plasma tends to drive it away from the longitudinal axis and the plasma is forced out of the coil 22 in a direction parallel to the longitudinal axis of the coil.

During the compression, the dense plasma and gas in the narrow end of the coil 22 are under high pressure and temperature and are thus available for use as a high pressure gas. This plasma ruptures the thin mylar foil 34 and strikes the beads 36 causing the beads 36 to be propelled at hypervelocities.

As a result of the gas being forced ahead of the ionized plasma, such adds to the driving medium engaging the beads 36. Furthermore, the accumulated gas is cooler than the metal plasma thus there is a lower eroding effect on the particles 36 being accelerated.

During the energization of the plasma compressor, it is positioned within a vacuum chamber which surrounds the entire apparatus. In one particular test, the beads which are expelled when the mylar member 34 is ruptured by the plasma, are propelled towards a target carried on an inner end of the vacuum chamber. This target may be any suitable material, such as the skin of a spacecraft, and from these tests it can be determined if meteoroids will damage or penetrate such in space flight. Of course, other tests could be performed on similar objects. The compressor could also be used for providing a dense high temperature plasma that may possibly have many applications and use.

While a preferred embodiment of the invention has been described using specific terms, such description is for illustrative purposes only, and it is to be understood that changes and variations may be made without departing from the spirit or scope of the following claims.

What is claimed is:

1. An apparatus for accelerating and compressing plasma comprising:

a. an elongated cylindrical first electrode;

b. a central rod electrode disposed coaxially of said first electrode out of contact therefrom;

c. an electrically conductive element extending between said central rod electrode and an inner end of said first electrode;

d. a plug sealing said inner end of said first electrode;

e. a rupturable seal carried over an outer end of said first electrode;

f. means for inserting gas within said elongated cylindrical first electrode;

g. an elongated electrically conductive helical coil having a large diameter end and a small diameter end;

h. said large diameter end of said helical coil being carried adjacent said outer end of said first electrode and said small diameter end being spaced longitudinally therefrom;

i. means for electrically connecting the small diameter end of said helical coil to said first electrode;

j. means for applying a high voltage to said first electrode and said central rod electrode for causing said electrically conductive element to ionize producing a plasma which is accelerated forcing said gas out of said outer end of said first electrode; and k. said helical coil being in axial alignment with said elongated cylindrical first electrode so that a current path is formed between an outer end of said central rod electrode and said helical coil as said plasma is accelerated out the outer end of said first electrode producing current flow through said helical coil, which in turn produces a time varying magnetic field that compresses said plasma and gas adjacent said small diameter end of said coil;

whereby a source of compressed plasma is produced adjacent said small diameter end of said helical coil.

2. The apparatus as set forth in claim 1, further comprising:

a. an insulating housing having an inner end and an outer end with said outer end carried on and encircling said outer end of said cylindrical first electrode;

b. a main body portion of said insulating housing encircling said helical coil;

c. an electrically conductive member enclosing said outer end of said insulating housing and being in electrical contact with said small end of said helical coil; and d. means for electrically connecting said electrically conductive member to said first electrode.

3. The apparatus as set forth in claim 1 further comprising:

a. a thin foil member carried adjacent said small diameter end of said helical coil; and b. a supply of beads carried on an outer surface of said thin foil member so that said compressed plasma and gas penetrate said thin foil member propelling said beads to high velocities.

4. An apparatus for accelerating and compressing plasma comprising:

a. an elongated cylindrical first electrode having open inner and outer ends;

b. a central rod electrode disposed coaxially of said first electrode out of contact therefrom;

c. means for sealing said inner end of said first electrode;

d. an electrically conductive element extending between said central rod electrode and said inner end of said first electrode;

e. an elongated electrically conductive helical coil having a large diameter end and a small diameter end;

f. said large diameter end of said helical coil being carried adjacent but spaced from said outer end of said first electrode and said small diameter end being spaced longitudinally therefrom;

g. a sealed housing having a chamber therein encompassing said outer end of said cylindrical first electrode and said helical coil;

h. means for inserting gas within said elongated first electrode and said chamber in said sealed housing;

i. means for applying a high voltage to said first electrode and said central rod electrode for causing said electrically conductive element to ionize producing a plasma which is accelerated forcing said gas out of said outer end of said first electrode, and j. said helical coil being in axially alignment with said elongated cylindrical first electrode so that a current path is formed between an outer end of said central rod electrode and said helical coil as said plasma is accelerated out the outer end of said first electrode producing current flow through said helical coil, which in turn produces a time varying magnetic field that compresses said plasma and gas adjacent said small diameter end of said coil;

whereby a source of compressed plasma is produced adjacent said small diameter end of said helical coil.

5. The apparatus as set forth in claim 4, further comprising:

a. a thin foil member carried adjacent said small diameter end of said helical coil, and b. a supply of beads carried on an outer surface of said thin foil member so that said compressed plasma and gas penetrates said thin foil member propelling said beads to high velocities.

* * * * *

UNITED STATES PATENT AND TRADEMARK OFFICE

CERTIFICATE OF CORRECTION

PATENT NO. : 3,939,816

DATED : Feb. 24, 1976

INVENTOR(S) : Patrick N. Espy

It is certified that error appears in the above-identified patent and that said Letters Patent are hereby corrected as shown below:

In the heading to the printed specification, immediately after line 3 listing the name and address of the inventor, delete the following--

-- [73] ASSIGNEE: The United States of America
As Represented By The Administrator
of The National Aeronautics and Space
Administration, Office of General
Counsel - Code GP, Washington, D.C. --

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*